United States Patent [19]

Shostak et al.

[11] Patent Number: 4,610,016

[45] Date of Patent: Sep. 2, 1986

[54] INDUSTRIAL FURNACE

[75] Inventors: Valentin M. Shostak; Alexei I. Tolochko; Vasily P. Volkov; Georgy I. Maradudin, all of Kharkov; Nikolai G. Schekin, Ljubotin Kharkovskoi; Mikhail I. Popov; Dmitry N. Shepelev, both of Bor; Anatoly I. Matveev; Alexandr I. Butnyakov, both of Bor; Anatoly P. Rzhavichev, Bor, all of U.S.S.R.

[73] Assignee: Vsesojuzny Nauchno-Issledovatelsky I Proektny Institut Po Ochistke Tekhnologicheskikh Gazov, Stochnykh Vod I Ispolzovaniju Vtorichnykh Energoresursov Predpriyaty Chernoi Metallurgii, Kharkov, U.S.S.R.

[21] Appl. No.: 673,611

[22] Filed: Nov. 21, 1984

[51] Int. Cl.[4] ..... F27D 1/00

[52] U.S. Cl. ..... 373/137; 373/30; 373/71; 373/122

[58] Field of Search ..... 373/30, 31, 32, 36, 373/37, 38, 39, 41, 71, 119, 122, 120, 137; 266/280; 432/248

[56] References Cited

U.S. PATENT DOCUMENTS

| | | | |
|---|---|---|---|
| 2,855,450 | 10/1958 | Eden | 373/39 |
| 4,027,091 | 5/1977 | Pieper | 373/41 |

FOREIGN PATENT DOCUMENTS

| | | |
|---|---|---|
| 136876 | 10/1969 | Czechoslovakia . |
| 1198501 | 2/1966 | Fed. Rep. of Germany . |
| 733294 | 7/1981 | U.S.S.R. . |

*Primary Examiner*—Roy N. Envall, Jr.

*Attorney, Agent, or Firm*—Fleit, Jacobson, Cohn & Price

[57] ABSTRACT

A characteristic feature of the furnace disclosed in the present invention is the presence therein of additional current-carrying elements with the free end thereof sunk relative to the effective area of the furnace brickwork. The elements are connected with the terminals of a power source of the opposite polarity with respect to the connection of the main current-carrying elements of a corresponding operating area.

1 Claim, 1 Drawing Figure

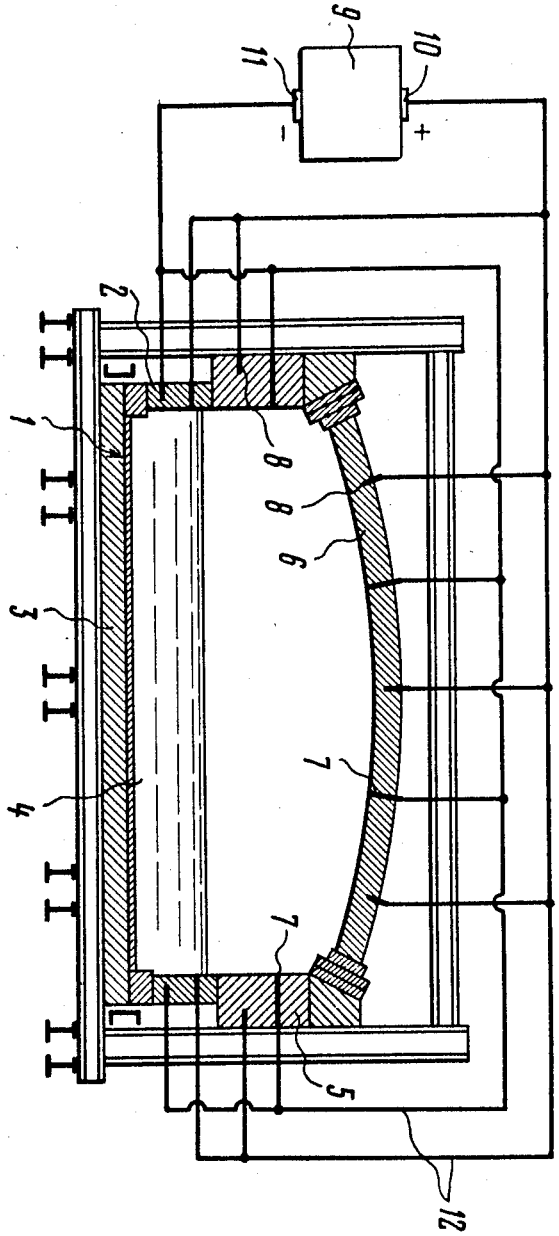
9
10
11
+
−
2
1
8
8
6
3
7
4
7
5
12

INDUSTRIAL FURNACE

The invention relates to the protection of refractory lining (brickwork) against wear with the aid of an electric field, and more specifically, to industrial furnaces being used in ferrous and non-ferrous metallurgy, and in glass manufacture.

The principal factors leading to wear of the refractory lining in operative industrial furnaces are thermal loads and high-temperature corrosion due to the action of melts and gases formed during the combustion of fuel, and liquid and gaseous products of the melting process.

The thermal loads imposed on the lining are characterized by non-uniformity of heat flows and temperature patterns, and by frequent temperature changes, which gives rise to stresses in the lining and, ultimately, to spalling of the latter.

The main effect produced by corrosion consists in that it breaks up the structure of the lining effective area contacting the melt and the gaseous medium in the furnace, thereby reducing its strength, which, in turn, considerably accelerates the process of spallation of the lining.

In an operative furnace the surface of the refractory material with the basis thereof formed by high-melting metal oxides (e.g. $Al_2O_3$, ZrO) is impregnated with different substances, such as metal melt and slags in metallurgical melting furnaces, siliceous mass in glass-making furnaces, heat-transfer agent melt in heating furnaces, and with gaseous products in all types of furnaces. As a result, a region with a complex structure and chemical composition is formed. The temperature in this region, which can feature the properties of both semi-conductors and solid electrolytes, is different at different points. Owing to this, a thermoelectromotive force (thermo-emf) arises between different areas of the surface, said emf generating electric current in the lining, which causes intensive electrochemical corrosion of the refractory material.

The magnitude and direction of the emf depend on the chemical composition of the refractory material impregnated with products contained in the furnace, and on the temperature difference. If this difference is small, we can assume that $E=\alpha\Delta T$, where E is the magnitude of the thermo-emf between two points, $\Delta T$ is the temperature difference therebetween, and $\alpha$ is a constant factor characterizing the composition of the substance. With the furnace functioning, the thermo-emf generally ranges from 0.5 to 2.0 V.

The mechanism and the rate of electrochemical corrosion can differ, depending on the nature of conductance in the region through which electric current flows. The conductance is normally of a mixed type, i.e. electronic and ionic.

To protect the refractory lining against corrosion, different methods are used.

In conformity with one of them at least one electrode made of a durable material is submerged into a melt-filled bath, and the refractory materials, whose basis is formed by zirconium oxide, are brought into contact with metal conductors. An external power source gives rise to a constant electromotive force acting between the conductors and the electrode submerged into the bath. As a result, electric current starts flowing in the latter from the electrode to the refractories to be protected. As the electromotive force is being adjusted, it causes an electrolytic current with a density of about 10 $mA/cm^2$ to flow across the surface of the refractory. Thus, corrosion slows down due to ionic exchange brought about by the difference of the chemical potentials of the substances making up the melt and those on the surface of the refractory.

A disadvantage of this method is that the latter is applicable only to refractories made on the basis of zirconium oxide. Moreover, it does not add substantially to the durability of the lining, for it decelerates only one type of corrosion, without affecting other types thereof. Another disadvantage consists in that the quality of the siliceous mass in glass-making furnaces will be impaired due to electric decomposition thereof by the current of the order of 10 $mA/cm^2$.

Another prior art method consists in that protection against corrosion is effected with the aid of electrodes placed in the melt and current carrying-elements in the intermediate coating of glaze on the refractory material, connected with the opposite terminals of a direct current source, with the emf thereof being adjusted in such a way that the current density on the surface of the contact between the melt and the refractory material is less than 1 $mA/cm^2$.

This decision cannot provide considerable increase of the service life of the lining, either for it decelerates only the electrolytic corrosion of the lining effective area where the latter contacts the melt.

Also known in the art is a furnace designed to prolong the service life of the refractory lining, comprising a bath made of a refractory material and filled with a siliceous melt, and current-carrying elements disposed in the refractory and extending to the operating area thereof below and above the level of the melt, and connected with the negative and the positive terminals of a direct current source, respectively.

Said design makes it possible to balance the thermo-emf between different zones of the effective area of the refractory lining.

As a result, the currents flowing on the surface and causing corrosion of the refractory become less intensive. There are also other mechanisms of corrosion, the protection against which in the furnace in question is unfeasible and, consequently, the extension of the service life of the lining proves insufficient.

The main object of the present invention is to provide an industrial furnace with a specific design and arrangement of current-carrying elements relative to the effective area of the furnace brickwork.

Another object of the invention is to ensure a long service life for the furnace refractory lining.

Still another object of the invention is to increase the furnace capacity by reducing the idle time due to repairs.

The foregoing objects are attained in a furnace comprising a bath of refractory material, filled with melt, and main current-conducting elements with the free end thereof extending to the effective area of the brickwork below and above the level of the melt, connected with the opposite terminals of a direct current source, according to the invention, and also provided with additional current-carrying elements with the free end thereof sunk in the brickwork relative to the operating area thereof, and connected with the terminals of a power source of the opposite polarity with respect to the connection of the main current-carrying elements of a corresponding operating area.

Such an embodiment of the invention ensures an optimal protection of the refractory brickwork against corrosion and a longer service life thereof.

The essence of the invention consists in the following.

With the furnace operating, a great temperature difference arises between the operating area of the refractory brickwork and the internal region thereof. Owing to this, a thermo-emf, and, consequently, electric current, is generated between the effective area and the internal region of the lining. Said current gives rise to intensive electrochemical corrosion in the lining, thus promoting the appearance of a defective structure in thick surface layers and a sharp loss of strength to a great depth.

Research has revealed that the presence in the brickwork of additional current-carrying elements with the free end thereof sunk in the brickwork relative to the operating area thereof and connected with the terminals of a power source of the opposite polarity with respect to the connection of the main current-carrying elements largely reduces volumetric corrosion.

It has also been established that in this case the depth of penetration of the molten mass (melt), and also of the products of melting and fuel combustion, into the refractory is decreased, and the process of change in the chemical and mineralogical composition of the refractory and formation of a band structure throughout the brickwork is decelerated. The formation of the defective structure, too, slows down considerably. As a consequence of all these factors, the strength of the refractory is maintained at a high level during an appreciable stretch of time, spalling of the refractory is averted, and a long service life for the brickwork is ensured.

Substantially, the furnace allows the service life of the refractory lining to be nearly doubled, owing to which the capacity of the furnace increases due to its longer campaign, and the idle time required to replace the worn-out brickwork is reduced. A major advantage of the furnace is that the modernization thereof in accordance with the invention is rather cheap, for it does not necessitate remodelling of the main structures of the furnace, thereby obviating the need for capital outlays. On the other hand, repair expenditures are cut down. Another advantage is that the given embodiment of the furnace is simple to operate.

The invention will now be described in greater detail with reference to a specific embodiment thereof, taken in conjunction with the accompanying drawing, illustrating a cross-section of an industrial glass-making furnace with additional current-carrying elements, and a diagram of their connection with a current source.

The furnace shown in the drawing comprises a bath 1 formed by walls 2 and a hearth 3, both made of a refractory material, a molten siliceous mass 4, walls 5 of the furnace upper portion, and a roof 6, said walls and roof also made of a refractory material. Provided in the refractory brickwork of the roof 6 and the walls 5 above the level of the melt are main current-carrying elements 7 with the free ends thereof extending to the brickwork operating area, and additional current-carrying elements 8 with the free ends thereof sunk in the brickwork relative to the operating area thereof.

All current-carrying elements are actually 1.5–2.0 mm thick stainless steel plates; said elements can also be made of other widely used durable materials, e.g. platinum, molybdenum and the like.

The furnace also contains a direct current source 9 with a positive terminal 10 and a negative terminal 11. The main current-carrying elements 7 located below the level of the melt 4 are connected with the terminal 10, and the main current-carrying elements 7 disposed above the level of the melt 4 are connected with the terminal 11. The additional current-carrying elements 8 located below the level of the melt 4 are connected to the terminal 11, and the additional current-carrying elements 8 disposed above the level of melt 4 are connected to the terminal 10. The connections are made with the aid of wires 12.

The furnace described hereinabove operates in the following manner.

In processing the molten siliceous mass 4 a thermo-emf is generated in the refractory brickwork of the walls 2 and 5, the hearth 3 and the furnace roof 6 between the operating area of the brickwork and the internal region thereof due to the temperature difference therebetween and difference in the chemical composition, brought about by the refractory being impregnated with the molten mass and melting products contained in the furnace gaseous medium, and also due to different structure of the surface and bottom layers. A thermo-emf is also initiated between the operating area of the brickwork below and above the level of the melt, said thermo-emf being induced primarily by the difference in the chemical composition of the products impregnating the surface of the lining in these zones. It should be noted that the charge on the surface of the walls 5 and the roof 6 above the level of the melt and the charge of the internal region of the brickwork of the walls 2 below the level of the melt will be positive both with respect to the charge of the internal zone of the walls 5 and the roof 6 above the level of the melt and with respect to the charge on the surface of the walls 2 below the level of the melt. The potential difference will fluctuate within 0.7 to 1.0 V.

After all the current-carrying elements 7 and 8 have been connected with the terminals 10 and 11 of the direct current source 9 by means of the connecting wires 12, as shown in the drawing, a voltage of 3.0 or 4.0 V is fed to the current-carrying elements.

The direction of the resultant electric field generated in the lining by the current-carrying elements is opposite to that of the thermo-emf in all zones of the lining.

Owing to the fact that the current source feeds a voltage exceeding the value of the thermo-emf, the electric field produced by the current-carrying elements proves insufficiently strong for reliable neutralization of corrosion provoking currents, in spite of a discrete arrangement of the current-carrying elements in the lining and a certain voltage grop across the connecting wires. Thus, the destruction of the furnace refractory lining is decelerated.

It is apparent, therefore, that the furnace of the present invention features considerable advantages over prior art embodiments, for it allows the service life of the refractory lining to be extended and the economic indices thereof to be improved accordingly.

What is claimed is:

1. An industrial furnace comprising:

a bath made of a refractory material for filling with a melt;

a direct current source;

main current-carrying elements having free ends extending to an operating area of said refractory material of the bath below and above the melt, and said main current-carrying elements extending to said operating area below the melt being connected with opposite terminals of said current source from said main current-carrying elements extending to said operating area above the melt; and additional current-carrying elements having free ends sunk in said refractory material of the bath below and above the melt and said additional current-carrying elements being connected with the terminals of said power source of opposite polarity with respect to the connection of the main current-carrying elements of a corresponding part of said operating area.

* * * * *